US011473279B2

(12) United States Patent
Lu et al.

(10) Patent No.: US 11,473,279 B2
(45) Date of Patent: Oct. 18, 2022

(54) SWITCH DETECTION ASSEMBLY AND FAUCET HAVING THE SAME

(71) Applicant: XIAMEN IEBS HI-TECH CO., LTD., Xiamen (CN)

(72) Inventors: Yang Lu, Xiamen (CN); Xinxing Wang, Xiamen (CN)

(73) Assignee: XIAMEN IEBS HI-TECH CO., LTD, Xiamen (CN)

( * ) Notice: Subject to any disclaimer, the term of this patent is extended or adjusted under 35 U.S.C. 154(b) by 110 days.

(21) Appl. No.: 17/018,343

(22) Filed: Sep. 11, 2020

(65) Prior Publication Data

US 2021/0293007 A1 Sep. 23, 2021

(30) Foreign Application Priority Data

Mar. 17, 2020 (CN) ..... 202010187929.5

(51) Int. Cl.
*E03C 1/04* (2006.01)
*E03C 1/05* (2006.01)

(52) U.S. Cl.
CPC ..... *E03C 1/0412* (2013.01); *E03C 1/057* (2013.01); *E03C 2001/0415* (2013.01); *Y10T 137/9464* (2015.04)

(58) Field of Classification Search
None
See application file for complete search history.

(56) References Cited

U.S. PATENT DOCUMENTS

| | | | | |
|---|---|---|---|---|
| 9,637,895 | B2 | 5/2017 | Song | |
| 10,612,221 | B2 | 4/2020 | Yan | |
| 2013/0248617 | A1* | 9/2013 | Sawaski | E03C 1/0404 239/73 |

FOREIGN PATENT DOCUMENTS

| | | | |
|---|---|---|---|
| CN | 203927007 | U | 11/2014 |
| CN | 204664556 | U | 9/2015 |
| CN | 204664566 | U | 9/2015 |
| CN | 206135869 | U | 4/2017 |
| CN | 108231444 | A | 6/2018 |
| CN | 110440044 | A | 11/2019 |

* cited by examiner

*Primary Examiner* — Daphne M Barry
(74) *Attorney, Agent, or Firm* — Bayramoglu Law Offices LLC

(57) ABSTRACT

The present invention relates to a switch detection assembly and a faucet having the same. The switch detection assembly is used to perform switch detection on a movement stroke of a linear continuous shape object, and includes a sleeve sliding pair, the sleeve sliding pair has a movement stroke in a first direction and a movement stroke in a second direction which deviate from each other in direction, the sleeve sliding pair is used for the linear continuous shape object to extend and receives an unidirectional force of the object to generate the movement stroke in the first direction, the movement stroke in the second direction of the sleeve sliding pair can be continuously reset, and the movement stroke is accepted and a switch signal output is generated. The present invention ensures the continuity of the water outlet pipeline, avoids water leakage, and saves production and assembly process.

17 Claims, 15 Drawing Sheets

SWITCH DETECTION ASSEMBLY AND FAUCET HAVING THE SAME

TECHNICAL FIELD

The present invention relates to a switch detection assembly and a faucet having the same.

BACKGROUND

With the improvement of people's living standard, the requirement for home life is gradually rising. The pull-out faucet is a type of faucet that has appeared in recent years. Compared with the traditional faucet, the pull-out faucet can not only pull out a spray head to expand the cleaning area, but also freely rotate the spray head to clean the blind spot of an article. At present, the conventional pull-out faucet still controls the water by means of a manual valve or shielding induction of an infrared sensor. In the intelligent control faucet disclosed in Chinese utility model patent with authorization publication number CN204664566U and CN203927007U, a manner of pulling out a water pipe to control the opening and closing of a water route is proposed, which is mainly to control the on and off of the signal by making a magnetic starting mechanism (magnet+degaussing piece) or a magnet mounted over a water outlet pipe be relatively close to or far away from a magnetic reed switch. Since the water outlet pipe revolves in the elbow, the structures of both the snare degaussing piece 721 in the embodiment of CN204664566U and the sleeving magnet 72 in the embodiment of CN203927007U are to ensure that a trigger magnetic field can be counteracted or generated for the magnetic reed switch no matter how the water outlet pipe revolves. However, since the water outlet pipe is usually a braided hose with joints at both ends, in order to reliably mount the magnetic starting mechanism or magnet of the sleeve structure over the water outlet pipe, the water outlet pipe needs to be cut, and then the magnetic starting mechanism are connected to the two water outlet pipes by joints, so that there is a risk of water leakage from the water pipe. Moreover, when the pull-out faucet is in use, the pipeline will inevitably sway in the gap space of the elbow. Therefore, if a magnetic starting mechanism is to be used, a certain strong magnetic force is required to ensure the accuracy of signal control, which will inevitably lead to the strong magnetic field interferes with the normal operation of other electronic control components (such as an infrared sensor) in the faucet. How to improve these deficiencies and proposing a safer and more suitable pull-out triggered faucet is a general need in the industry.

SUMMARY

Therefore, as for the above-mentioned problems, after the inventor's intensive research, the present invention proposes a switch detection assembly and a faucet having the same with an optimized structure.

The present invention is achieved by the following technical solutions:

The present invention proposes a switch detection assembly used to perform switch detection on a movement stroke of a linear continuous shape object, including a sleeve sliding pair, the sleeve sliding pair has a movement stroke in a first direction and a movement stroke in a second direction which deviate from each other in direction, the sleeve sliding pair is used for the linear continuous shape object to extend and receives an unidirectional force of the object to generate the movement stroke in the first direction, the movement stroke in the second direction of the sleeve sliding pair can be continuously reset, and the movement stroke is accepted and a switch signal output is generated.

Wherein the above switch detection assembly further includes a fixing bracket, a movable sleeve, an elastic reset element, a diameter expanding element and an accepting element, the fixing bracket is fixedly provided and includes a fixing sleeve, the fixing sleeve has a passage for the linear continuous shape object to pass through, and defines two ends of the passage as a first end and a second end corresponding to the first direction and the second direction;

the movable sleeve is movably mounted over the fixing sleeve, so as to be able to make a linear reciprocating movement towards the first end or the second end relative to the fixing sleeve and have a movement stroke;

the fixing bracket and the movable sleeve form the sleeve sliding pair;

the elastic reset element is used to achieve the reset and includes a first force application action end and a second force application action end, the first force application action end and the second force application action end respectively act on the fixing sleeve and the movable sleeve, so that the elastic reset element generates an elastic restoring force against the movement of the movable sleeve towards the first end, and the elastic restoring force is in a direction towards the second end;

the diameter expanding element is used to achieve the unidirectional force application, and the diameter expanding element is fixedly installed in at least one position of the linear continuous shape object, so that when the linear continuous shape object moves towards the first end in the passage of the fixing sleeve, the diameter expanding element applies pressure to the movable sleeve and generates a movement stroke relative to the fixing sleeve;

the accepting element is used to accept the movement stroke and generate the switch signal output, the accepting element is installed in a range roughly equivalent to the movement stroke of the movable sleeve, so that when the movable sleeve makes the linear reciprocating movement, the accepting element can accept stroke change of the movable sleeve and generate the switch signal output.

Wherein in order to mount the movable sleeve over the fixing sleeve and provide a portion to which the diameter expanding element applies force, the movable sleeve includes a vertically provided pipe body, an inner cavity of the pipe body is a through shaft hole, the pipe body has a first pipe port at an end facing the first direction and has a second pipe port at an end facing the second direction, a diameter reducing part extending radially to a center of circle is provided at the second pipe port.

Wherein in order to enable the movable sleeve to obtain the movement stroke, the diameter expanding element applies pressure to the diameter reducing part of the movable sleeve, so that the movable sleeve generates a movement stroke relative to the fixing sleeve.

Wherein in order to save installation space and provide the elastic reset element with a force application action portion, the fixing sleeve is a hollow pipe body, the fixing sleeve has a protruding part protruding outwards along an outer pipe wall of the fixing sleeve, the protruding part is for the first force application action end of the elastic reset element to act on, the elastic reset element is a compression spring, one end of the compression spring resists and acts on the protruding part as the first force application action end, and another end of the compression spring resists and acts on the diameter reducing part as the second force application action end.

Wherein for manufacturing and cost considerations, the protruding part is an annularly convex shaft shoulder on the outer pipe wall of the fixing sleeve.

Wherein in order to limit a range of the movement stroke of the movable sleeve, the movable sleeve and the fixing sleeve are provided with a limiting mechanism that limits a range of the movement stroke of the movable sleeve.

Wherein in order to limit a range of the movement stroke of the movable sleeve and for manufacturing and cost considerations, the first pipe port of the movable sleeve has a convex clamping part extending radially to the center of circle, and when the movable sleeve is mounted over the fixing sleeve, the clamping portion can pass over the protruding part; limiting in one direction of the limiting mechanism is achieved by limiting of the clamping part and the protruding part.

Wherein for manufacturing and installation considerations, the clamping part is an annular convex.

Wherein the elastic reset element may also be one of an elastic piece, an extension spring, and a tension rope.

Wherein in order to make the accepting element generate the switch signal more precisely, the movable sleeve further includes an extension part that is fixedly connected to outside of the pipe body and extends towards the first direction or the second direction.

Wherein in order to make the accepting element generate the switch signal more precisely, when the movable sleeve makes the linear reciprocating movement, the extension part is relatively close to or far away from the accepting element, and the accepting element accepts stroke change of the movable sleeve according to the extension part being relatively close to or far away from the accepting element, and the accepting element generates a switch signal.

Wherein in order to improve accuracy of generating the switch signal when the movable sleeve makes the linear reciprocating movement, the movable sleeve and the fixing sleeve are provided with a circumferential limiting mechanism that limits rotation of the movable sleeve relative to the fixing sleeve.

Wherein in order to improve accuracy of generating the switch signal when the movable sleeve makes the linear reciprocating movement and for manufacturing and cost considerations, the fixing sleeve is provided with a limiting pin protruding outwards from the fixing sleeve, and a limiting groove is provided on the movable sleeve at a position corresponding to the limiting pin.

Wherein for manufacturing and cost considerations, the limiting groove is roughly "U" shaped.

Wherein in order to make the limiting structure more stable, there are two groups of the limiting pin and the limiting groove, which are distributed at 180°.

Wherein the accepting element may be a proximity sensor, an interrupt sensor or a mechanical triggering switch.

Based on the above switch detection assembly, the present invention also provides a faucet including a water inlet pipe, a water outlet pipe which can be pulled out, and a control system for controlling water inlet and/or water outlet manner, characterized by further including the above switch detection assembly, the switch detection assembly performs switch detection on a pull-out movement stroke of the water outlet pipe, generates a switch signal and delivers it to the control system, and the control system controls the water inlet and/or water outlet manner according to the switch signal.

The present invention has the following beneficial effects: the present invention does not need to cut the pipeline to install the switch detection assembly, and when applied in the faucet field, ensures the continuity of the water outlet pipeline, avoids the problem of water leakage, and saves the process of production and assembly; the present invention is more applicable, and the switch detection assembly provided by the present invention is suitable for various applications where the switch signal is triggered by a pull-out linear continuous shape object. Moreover, various proximity sensors, interrupt sensors, or pressure-triggered mechanical switches can be used, and the sensor type can be flexibly selected according to the device status to be used, accuracy requirement, installation space, and cost consideration.

DESCRIPTION OF THE REFERENCE NUMERALS

Figure 1:
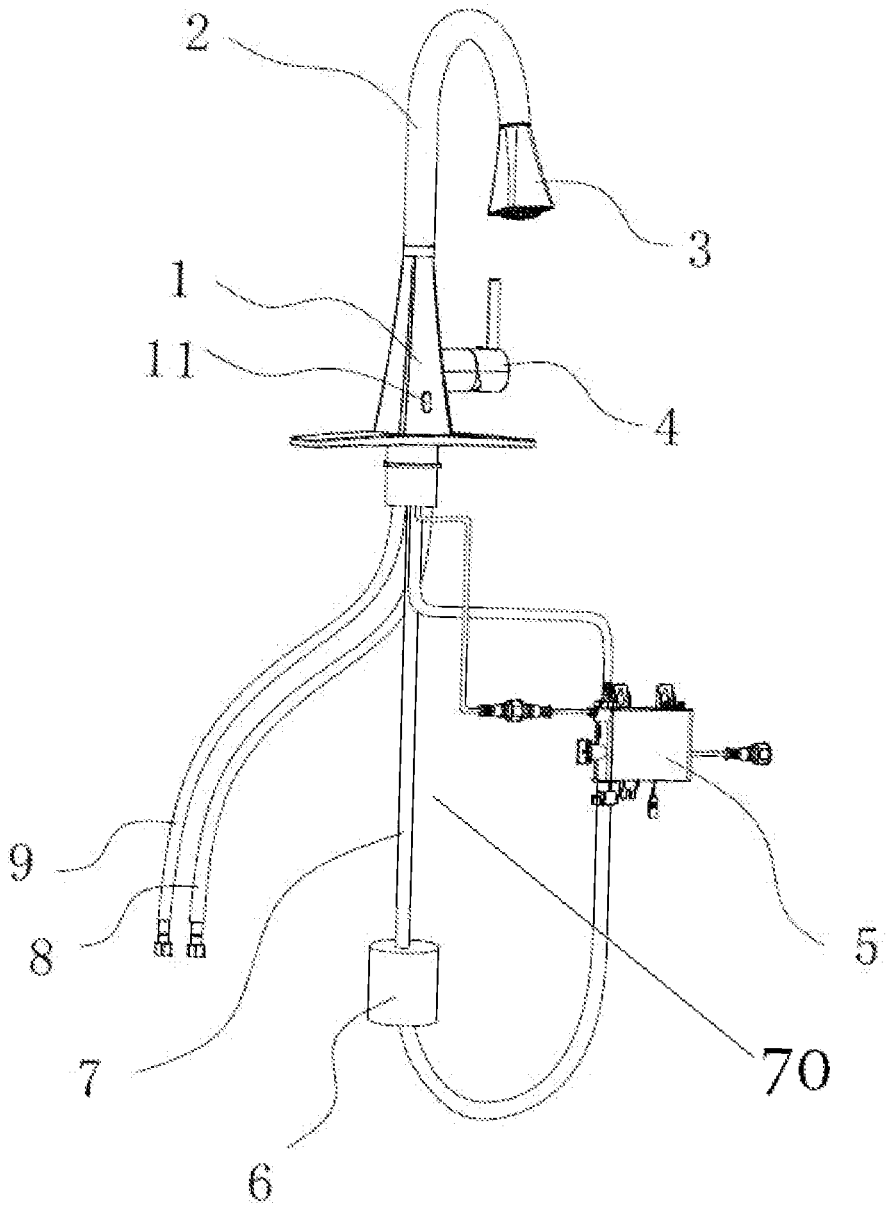
FIG. 1 is a schematic diagram of a pull-out faucet in Embodiment 1.
Figure 2:
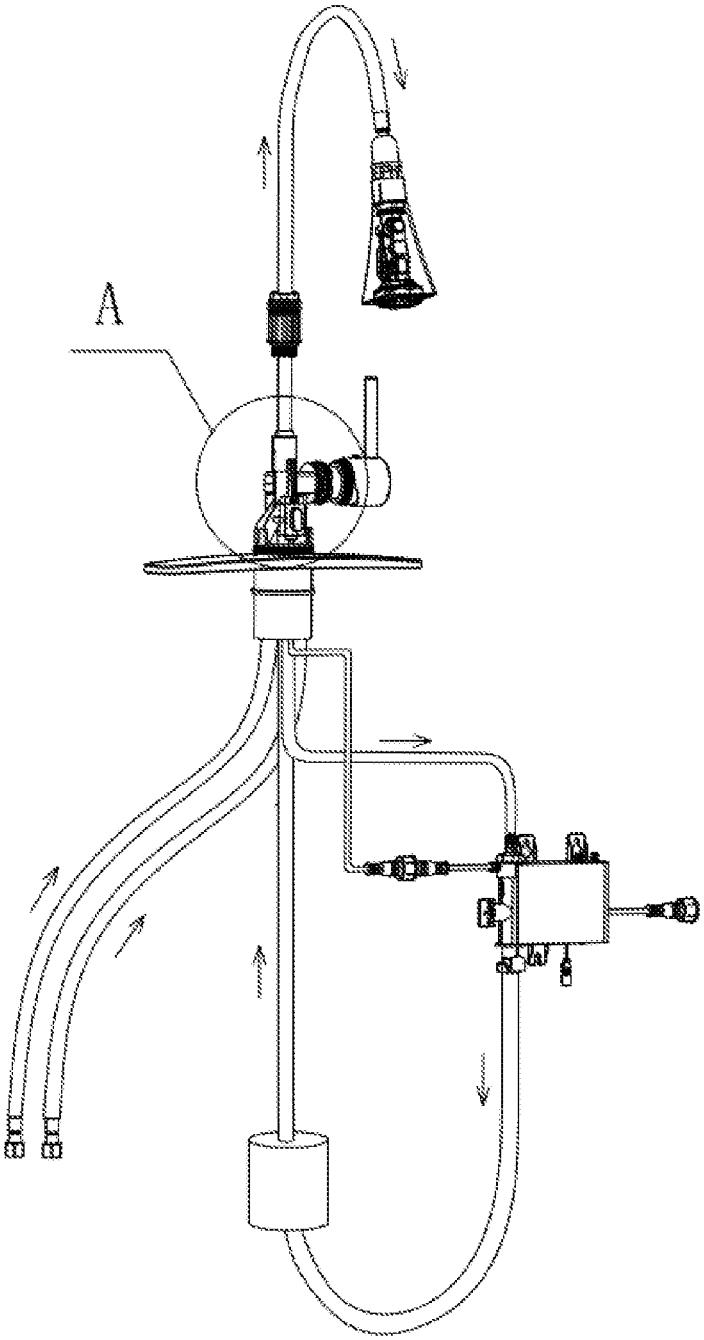
FIG. 2 is a schematic diagram of an internal structure and a flow direction of a pull-out faucet in Embodiment 1.
Figure 3:
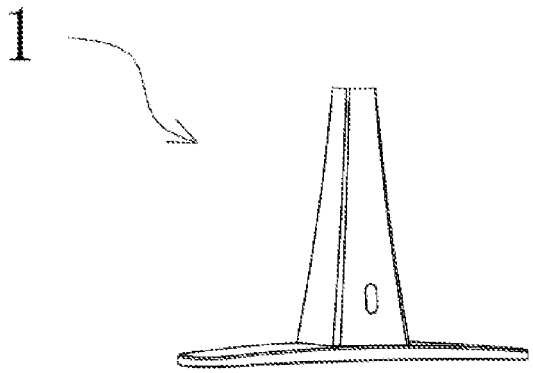
FIG. 3 is a schematic diagram of a faucet body of a pull-out faucet in Embodiment 1.
Figure 4:
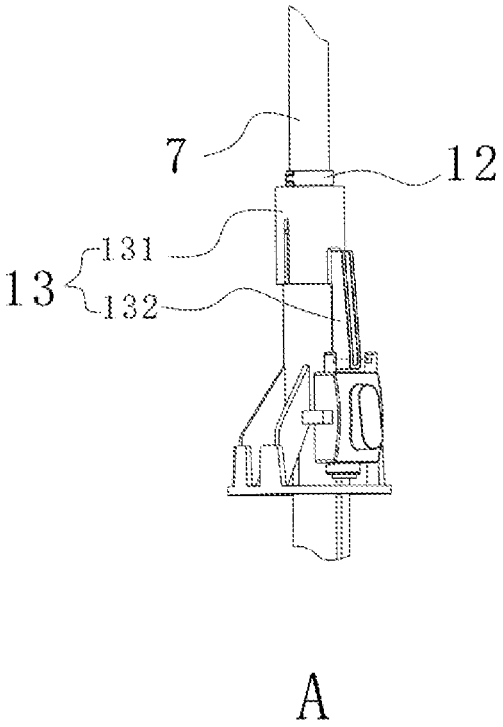
FIG. 4 is a partial enlarged view of the switch detection assembly at A in FIG. 2 (Part 1)
Figure 5:
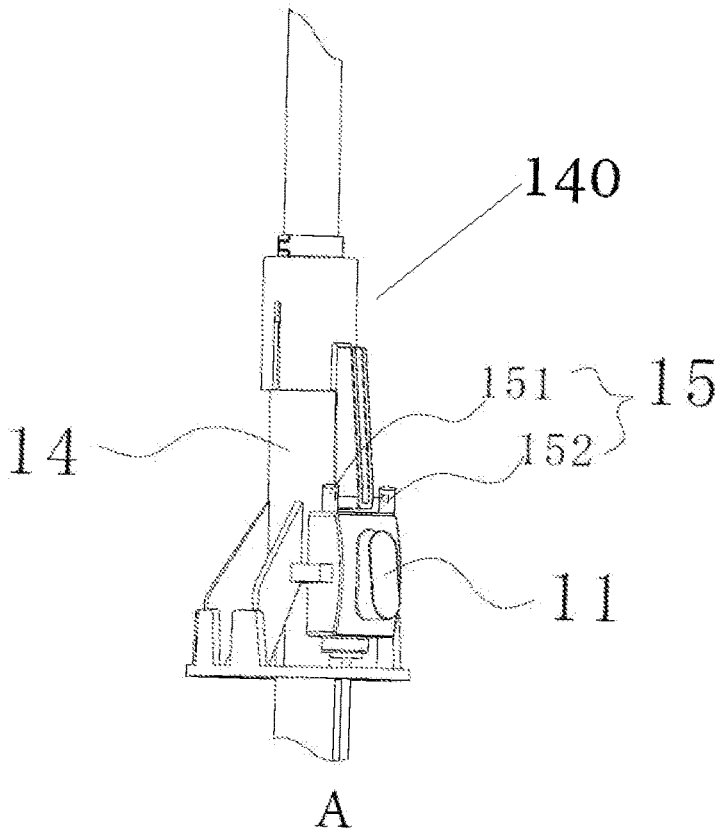
FIG. 5 is a partial enlarged view of the switch detection assembly at A in FIG. 2 (Part 2)
Figure 6:
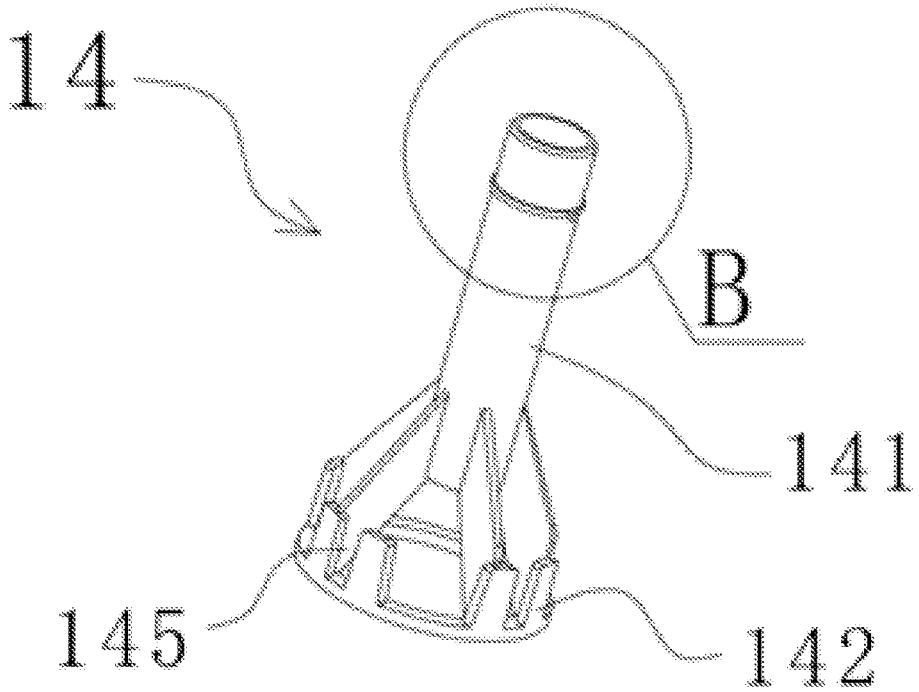
FIG. 6 is a schematic diagram of a fixing sleeve of a pull-out faucet in Embodiment 1.
Figure 7:
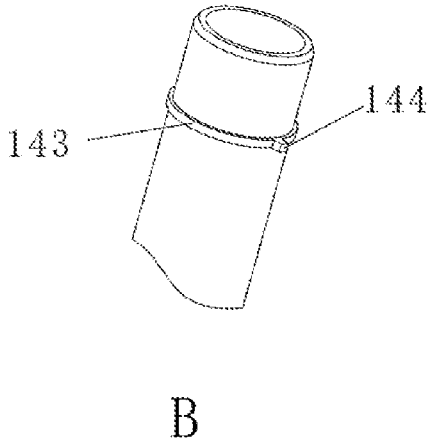
FIG. 7 is a partial enlarged view of B in FIG. 6.
Figure 8:
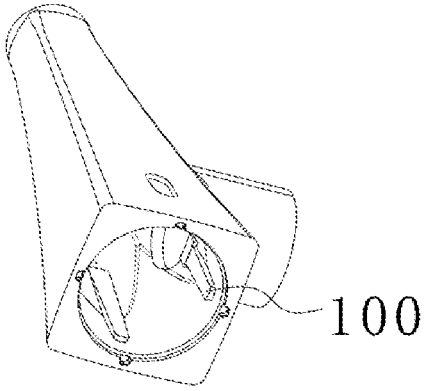
FIG. 8 is a schematic diagram of a spline structure inside a faucet body of a pull-out faucet in Embodiment 1.
Figure 9:
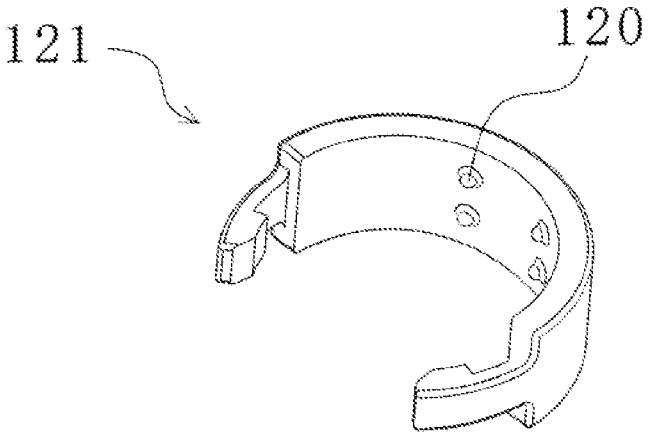
FIG. 9 is a schematic diagram of a clamping ring of a pull-out faucet in Embodiment 1 (Part 1)
Figure 10:
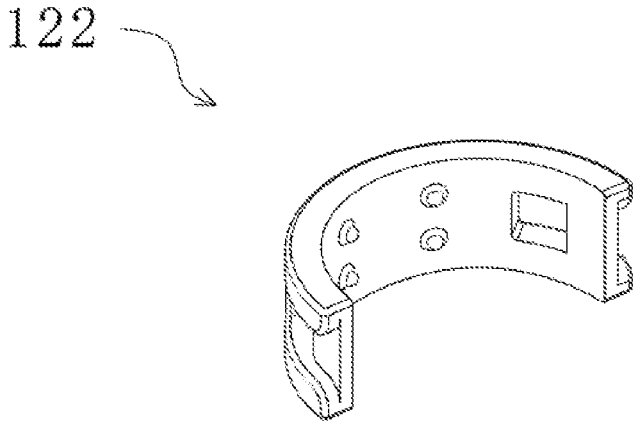
FIG. 10 is a schematic diagram of a clamping ring of a pull-out faucet in Embodiment 1 (Part 2)
Figure 11:
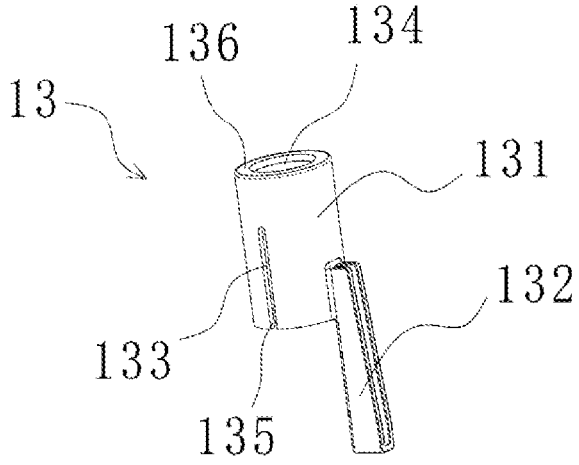
FIG. 11 is a schematic diagram of a sliding sleeve of a pull-out faucet in Embodiment 1.

1—faucet body; 2—elbow; 3—spray head; 4—handle; 5—controller; 6—heavy; 7—water outlet pipe; 8—cold water inlet pipe; 9—hot water inlet pipe; 11—infrared sensor; 100—spline;

12—snap ring; 120—circular convex column; 121,122—clamping ring;

13—sliding sleeve; 131—pipe body part; 132—extension part; 133—limiting groove; 134—shaft hole; 135—clamping part; 136—upper end;

14—fixing sleeve; 141—sleeving pipe; 142—circular base; 143—shaft shoulder; 144—limiting pin; 145—insertion groove;

15—opposite photoelectric sensor; 151—first transmitting terminal; 152—first receiving terminal;

16—compression spring;

17—first reflective photoelectric sensor; 171—second transmitting terminal; 172—second receiving terminal; 173—first reflective plate;

18—ultrasonic sensing assembly; 181—ultrasonic sensor; 182—second reflective plate;

19—Hall sensing assembly; 19—magnet; 192—magnetic reed switch;

20—micro switch assembly; 201—pressure plate; 202—micro switch;

21—capacitance sensing assembly; 211—conductive rubber skin; 212—capacitor;

22—second reflective photoelectric sensor; 221—third reflective plate; 222—third transmitting terminal; 223—third receiving terminal.

DETAILED DESCRIPTION OF THE EMBODIMENTS

In order to further illustrate various embodiments, the present invention is provided with drawings. These drawings are a part of the disclosure of the present invention, which are mainly used to illustrate the embodiments and can explain the operation principle of the embodiments in cooperation with the related description in the specification. With reference to these contents, those of ordinary skill in the art should be able to understand other possible embodiments and advantages of the present invention. The assembly in the drawings are not drawn to scale, and similar assembly symbols are usually used to indicate similar assembly.

The present invention will now be further described with reference to the drawings and specific embodiments.

Embodiment 1

Referring to FIGS. 1 to 12, this embodiment provides a pull-out faucet, which mainly includes a faucet body 1, an elbow 2, a spray head 3, a handle 4, a controller 5, a heavy 6, a water outlet pipe 7, a cold water inlet pipe 8, a hot water inlet pipe 9, and an infrared sensor 11.

Wherein the cold water inlet pipe 8 and the hot water inlet pipe 9 are connected to a manual valve core inside the faucet body 1, and the handle 4 controls the opening and closing of the manual valve core. The controller 5 is connected in series on the pipeline of the water outlet pipe 7, and the controller 5 has a built-in magnetic valve (not shown) to control the on and off of the water outlet pipe 7. The infrared sensor 11 is used to sense the proximity of the hand and generate a switch signal to the controller 5, and then the controller 5 triggers the built-in magnetic valve to switch on and off. The water outlet pipe 7 is usually a pipeline made of soft material and extends inside the elbow 2. One end of the water outlet pipe 7 is connected to the spray head 3 at the end of the elbow 2, and the water outlet pipe 7 is located under the table. The periphery of the water outlet pipe 7 needs to be wrapped by and fixedly provided with the heavy 6 for generating a pull-down force by gravity. In some occasions, the faucet of the embodiment washes different positions on the table by pulling out the water outlet pipe 7 by pulling out the spray head 3. After use, the spray head 3 is released, and the heavy 6 generates the pull-down force by its gravity, to drive the water outlet pipe 7 to move down to return to the original position, so that the spray head 3 returns to the position at the end of the elbow 2 again. For the convenience of the following description, in this embodiment, it is defined that after the pull-out faucet is installed on the washing table, the side facing the upper side of the washing table is regarded as the upper side, and the side facing the lower side of the washing table is regarded as the lower side.

Similar to the technical solutions in CN204664566U and CN203927007U, in order to achieve one more control manner, that is, the action of pulling out or returning the spray head 3 can generate a switch signal to the controller 5, and then the controller 5 triggers the built-in magnetic valve to switch on and off, thereby opening or closing the water outlet pipe 7. This embodiment is also provided with another set of switch detection assembly capable of detecting the action of pulling out or returning the spray head 3 to generate a switch signal.

The switch detection assembly includes:

A fixing bracket 140, the fixing bracket 140 has a passage for a tubular (or linear continuous shape such as linear and cord) object 70 to pass through, and the fixing bracket 140 is fixedly installed as a combined base of the switch detection assembly. Exemplarily, in this embodiment, the shape of the above-mentioned fixing bracket 140 is the shape of the fixing sleeve 14 shown in the figure of the embodiment that can match the inside of the faucet body 1 to achieve a fixing setting. The fixing sleeve 14 basically includes a vertical sleeving pipe 141 and a circular base 142 located at the lower end of the sleeving pipe 141, wherein the circular base 142 has an insertion groove 145 thereon, and the faucet body 1 has a spline 100 matching the insertion groove 145 therein. The spline 100 in the faucet body 1 is inserted into the insertion groove 145 of the fixing sleeve 14, and the circular base 142 of the fixing sleeve 14 is clamped on the inner cavity wall of the faucet body 1, thereby being fixed on the faucet body 1. Conventionally, the faucet body 1 can be installed above the installation table of the faucet, so the fixing sleeve 14 is also fixed relative to the installation table. The water outlet pipe 7 passes through the sleeving pipe 141 of the fixing sleeve 14, and the outer diameter of the water outlet pipe 7 is smaller than the inner diameter of the sleeving pipe 141, so that the water outlet pipe 7 can slide up and down inside the sleeving pipe 141. Both the insertion groove 145 and the spline 100 can be formed by casting and shaping. In another embodiment, the fixing sleeve 14 can be fixedly connected to the faucet body 1 by any other fixed connection manner (such as bonding and fixing), but the insertion manner in this embodiment saves the manufacturing process and facilitates installation.

A sleeve sliding sleeve, the sliding sleeve is mounted over the fixing bracket 140 and can make linear reciprocating movement on the fixing bracket 140. Exemplarily, in this embodiment, the above-mentioned sliding sleeve is the sliding sleeve is the sliding sleeve 13 movably mounted over the fixing sleeve 14 as shown in the figure of the embodiment, so that the sliding sleeve 13 has a through shaft hole 134 and can slide up and down relative to the fixing sleeve 14. The sliding sleeve 13 includes a pipe body part 131 and an extension part 132 fixed thereto. The pipe body part 131 of the sliding sleeve 13 is mounted over the sleeving pipe 141 of the fixing sleeve 14. The downwardly extended extension part 132 is integrally formed directly with the outer wall of the pipe body part 131. The pipe body part 131 has a diameter reducing part extending radially to the center of circle at the cylinder port of the upper end thereof, to form the upper end 136 of the pipe body part 131.

Figure 12:
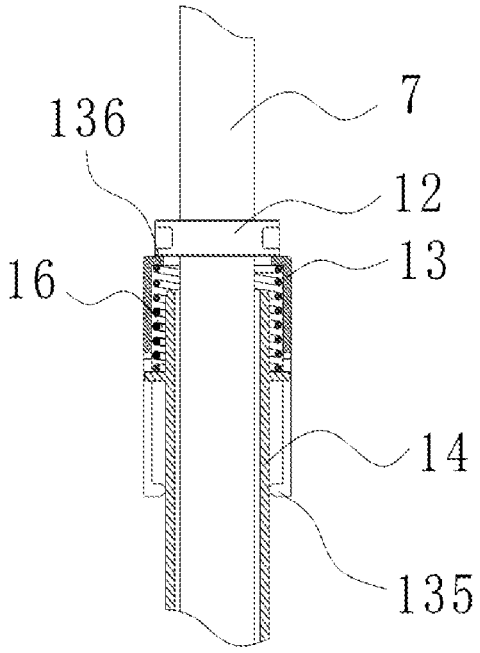
FIG. 12 is a cross-sectional view of connection structures of a snap ring, a fixing sleeve, a sliding sleeve and a compression spring in Embodiment 1.

An elastic reset element, the elastic reset element is installed on the fixing bracket 140, and when the sliding sleeve moves along the linear end of the fixing bracket 140 (downward or upward), the elastic reset element can generate an elastic restoring force towards the other end against the movement of the sliding sleeve (upward or downward). Exemplarily, in this embodiment, the above-mentioned elastic reset element is the compression spring 16 mounted over the sleeving pipe 141 of the fixing sleeve 14, and two force application action ends of the compression spring 16 act on the sliding sleeve 13 and the fixing sleeve 14 respectively. Referring to FIG. 12, in order to save installation space, the compression spring 16 is installed inside the sliding sleeve 13. A shaft shoulder 143 is provided on the sleeving pipe 141 of the fixing sleeve 14 for one end of the compression spring 16 (as the first force application action end) to abuts against. The other end of the compression spring 16 (as the second force application action end) abuts against the upper end 136 of the pipe body part 131 of the sliding sleeve 13, that is, the diameter reducing part where the shaft hole 134 extends radially to the center of circle. When the sliding sleeve 13 slides downwards, the compression spring 16 is compressed to generate an upward elastic restoring force. In this embodiment, the shaft shoulder 143 is an annular protrusion on the outer pipe wall of the fixing sleeve 14; the shaft shoulder 143 may also employ a plurality of protrusion blocks arranged circumferentially on the outer pipe wall of the fixing sleeve 14.

It should be noted that the compression spring 16 can also be implemented by other elastic reset elements such as air springs or tension ropes. In addition, the elastic reset element can also be an extension spring, as long as the action positions of the sliding sleeve 13 and the fixing sleeve 14 are interchanged. And in the application of other embodiments, according to different forms of used elastic reset elements, it is not limited to use the above-mentioned shaft shoulder 143 and the upper end 136 of the pipe body part 131 as the force application action ends of the elastic reset element, and all elastic reset element structures which can generate a potential energy moving towards the other end against the movement of the movable sleeve and corresponding elastic fixing end structures similar to the above-mentioned shaft shoulder 143 and the upper end 136 of the pipe body part 131 are all feasible solutions. For example, it is one of the feasible solutions that the elastic member is achieved by an elastic piece and the above-mentioned shaft shoulder 143 and the upper end 136 of the pipe body part 131 are replaced with a groove for clamping the elastic piece, and so on.

A diameter expanding element, the diameter expanding element is installed in at least one position of a tubular (or linear continuous shape such as linear and cord) object 70 passing through the passage of the fixing bracket 140. When the tubular object 70 moves, the diameter expanding element can apply pressure to the sliding sleeve and causes it to generate a linear movement stroke relative to the fixing bracket 140. Exemplarily, in this embodiment, the above-mentioned diameter expanding element is a snap ring 12 that is clamped on the water outlet pipe 7. The snap ring 12 includes two matching "U"-shaped clamping rings 121, 122, the clamping ring 121 has a snap block, and the clamping ring 122 has a neck. The maximum outer diameter of the snap ring 12 is greater than the minimum inner diameter of the shaft hole of the pipe body part 131 of the sliding sleeve 13. When the water outlet pipe 7 moves downwards, it drives the snap ring 12 fixed on it to move downwards at the same time. Since the snap ring 12 has a larger diameter than that of the water outlet pipe 7, the snap ring 12 can resist the upper end 136 of the sliding sleeve 13 when the snap ring 12 moves downwards, thereby applying pressure to the sliding sleeve 13 and forcing the sliding sleeve 13 to generate a linear movement stroke (slide downwards) relative to the fixing bracket 140. In this embodiment, in order to make the snap ring 12 more stably fixed on the water outlet pipe 7 without being easily displaced, the inner sides of the clamping rings 121 and 122 are provided with a circular convex column 120. When the snap ring 12 clamps the water outlet pipe 7, the circular convex column 120 abuts against the water outlet pipe 7 at the same time, so that the snap ring 12 is more stably fixed to the installation position of the water outlet pipe 7.

An accepting element, the accepting element is installed on the fixing bracket 140, and when the sliding sleeve is relatively far away from or close to the accepting element, the accepting element can accept the stroke change and generate a switch signal output. Exemplarily, in this embodiment, the above-mentioned accepting element is the opposite photoelectric sensor 15 provided on both sides of the movement path of the extension part 132 of the sliding sleeve 13. Then, according to the up and down movement position of the sliding sleeve 13, the extension part 132 is caused to interrupt or not interrupt the light delivery of the opposite photoelectric sensor 15 to generate two switch signals of on and off. The opposite photoelectric sensor 15 can be electrically connected to the controller 5, and deliver the switch signal to the controller 5. The controller 5 controls the opening and closing of the water flow of the water outlet pipe 7 according to the switch signal. The opposite photoelectric sensor 15 can use various light sources such as visible light (such as visible red light) or invisible light (such as infrared light).

In order to save installation space, the infrared sensor 11 is also installed on the circular base 142 of the fixing sleeve 14, and the opposite photoelectric sensor 15 is installed on the outer upper end of the box body of the infrared sensor 11.

In this embodiment, when the water outlet pipe 7 actuated by the heavy 6 synchronously drives the snap ring 12 fixed on it to move downwards, the snap ring 12 contacts the sliding sleeve 13, and applies pressure to the sliding sleeve 13 to force the sliding sleeve 13 to slide downwards. When the sliding sleeve 13 slides downwards, the compression spring 16 is compressed, so that the compression spring 16 generates an upward elastic restoring force (storing elastic potential energy). At this time, the water outlet pipe 7 is pulled up again, and the sliding sleeve 13 that is not pressed by the snap ring 12 will be rebounded and reset due to the elastic restoring force of the compression spring 16 (releasing elastic potential energy). In order to control the movement stroke of the rebounded sliding sleeve 13 (that is, in order to prevent the sliding sleeve 13 from being bounced off), the inner side at the cylinder port of the lower end of the pipe body part 131 of the sliding sleeve 13 is provided with a convex annular clamping part 135 extending radially to the center of circle (can also be replaced with a plurality of protrusions arranged along the circumference at the inner side of the cylinder port of the lower end of the pipe body part 131 of the sliding sleeve 13). The minimum diameter of the annular clamping part 135 is slightly smaller than the maximum diameter of the shaft shoulder 143 on the fixing sleeve 14 (not including the limiting pin 144 on the shaft shoulder 143). The pipe body part 131 of the sliding sleeve 13 is usually made of elastic plastic material. When the sliding sleeve 13 is installed on the fixing sleeve 14, the sliding sleeve 13 is pressed downwards, and the lower end of the pipe body part 131 is pushed to expand and deform so that the annular clamping part 135 passes over the shoulder 143 and then resets. Then the sliding sleeve 13 will be limited by the shoulder 143 when moving upwards.

When the pull-out faucet is in use, the water outlet pipe 7 is easily driven to displace or even revolve. Therefore, in order to improve the stability and accuracy of the signal triggering action, as a preferred implementation of this embodiment, a circumferential limiting structure is also added to perform circumferential limiting on the water outlet pipe 7 and the sliding sleeve 13, so as to prevent the rotation of the water outlet pipe 7 from driving the sliding sleeve 13 to rotate relative to the fixing sleeve 14. Therefore, the sliding sleeve 13 is provided with a U-shaped limiting groove 133, and a limiting pin 144 is formed by protruding from the fixing sleeve 14 (for example, at the position of the shaft shoulder 143). When the sliding sleeve 13 is mounted over the fixing sleeve 14, the limiting pin 144 falls into the limiting groove 133. The limiting pin 144 can not only limit the rotation of the sliding sleeve 13, but also limit the downward sliding distance of the sliding sleeve 13. In this embodiment, in order to better limit the position, there are two matched groups of the limiting pin 144 and the limiting groove 133, which are distributed at 180°.

In this embodiment, by way of explanation, a state where the sliding sleeve 13 moves towards the lower end of the fixing sleeve 14 in place is regarded as the first state (initial static state) of the switch detection assembly, and a state where the sliding sleeve 13 is pushed towards the upper end by the elastic restoring force of the elastic reset element (compression spring 16) and reset is regarded as the second state (dynamic state) of the switch detection assembly. In other applications, the above-mentioned upper end and lower end and the first state and second state of the corresponding switch detection assembly are also interchangeable. And, although the installation position of the accepting element in this embodiment is located at the lower end of the linear movement path of the sliding sleeve 13 as an example for illustration, those skilled in the art can change the installation position of the accepting element to the upper end of the linear movement stroke of the sliding sleeve 13 according to actual needs; and, in addition to the fixing bracket as the installation and fixing object of the accepting element, the accepting element can also be optionally installed on other components that do not participate in movement, such as the inner wall of the faucet body 1. In addition, in this example, the shapes of the sliding sleeve 13, the fixing sleeve 14, the passage of the fixing sleeve 14, and the water outlet pipe 7 are circular, and in other applications, the shapes can also be square or hexagonal.

The working principle of the pull-out faucet in this embodiment is:

When the faucet is not in use, due to the gravity of the heavy 6, the water outlet pipe 7 is pulled downwards, the snap ring 12 fixed on the water outlet pipe 7 presses the sliding sleeve 13 to force the sliding sleeve 13 to slide downwards, and the compression spring 16 is compressed at this time. Due to the elastic restoring force of the compression spring 16, after the sliding sleeve 13 slides downwards for a certain distance, the compression spring is compressed in place and/or the limiting pin 144 abuts against the limiting groove 133 and/or the extension part 132 abuts against the accepting element (the outer upper end of the box body of the infrared sensor 11 in the embodiment), and the entire switch detection assembly remains stationary. At this time, the extension part 132 of the sliding sleeve 13 shields the light emitted by the first transmitting terminal 151 of the opposite photoelectric sensor 15 to the first receiving terminal 152, and the first receiving terminal 152 cannot receive the light source signal from the first transmitting terminal 151.

After pulling the spray head 3, the water outlet pipe 7 moves upwards, and the snap ring 12 also moves upwards at the same time. The sliding sleeve 13 slides upwards due to the upward elastic restoring force of the compression spring 16 without being pressed by the snap ring 12. When the extension part 132 moves upwards, it no longer shields the light from the first transmitting terminal 151 of the opposite photoelectric sensor 15 and the first receiving terminal 152 receives the light source signal.

The movement of the sliding sleeve 13 caused by pulling out the water outlet pipe 7 forms the on and off of the signal to the opposite photoelectric sensor 15. The opposite photoelectric sensor 15 can be electrically connected to the controller 5 and deliver the signal to the controller 5. The controller 5 opens and closes the magnetic valve according to the on and off of the signal, thereby opening or closing the water discharge. In case of usage, when the spray head 3 is pulled, the water outlet pipe 7 can discharge water or discharge water with delay or not discharge water; and when the spray head 3 is put back, the water can be closed, thereby achieving multiple working modes such as "pull out to discharge water-put back to stop water", "pull out to discharge water with delay-put back to stop water" and "pull out not to discharge water-put back to stop water". In addition, if the controller 5 is connected to the water inlet pipe, it can also control the water inlet manner of the cold water inlet pipe 8 and the hot water inlet pipe 9.

In addition, in this embodiment, an infrared sensor 11 is also provided as a signal generator. The infrared sensor 11 and the opposite photoelectric sensor 15 can form various logical signals to achieve different water discharge and water close effects. For example, the water is discharged after the spray head 3 is pulled out, and the water is closed when the infrared sensor 11 is shielded. The water discharge and water close effects under various logics is obviously achievable to those skilled in the art, on the basis of the technology provided by this embodiment.

Embodiment 2

Figure 13:
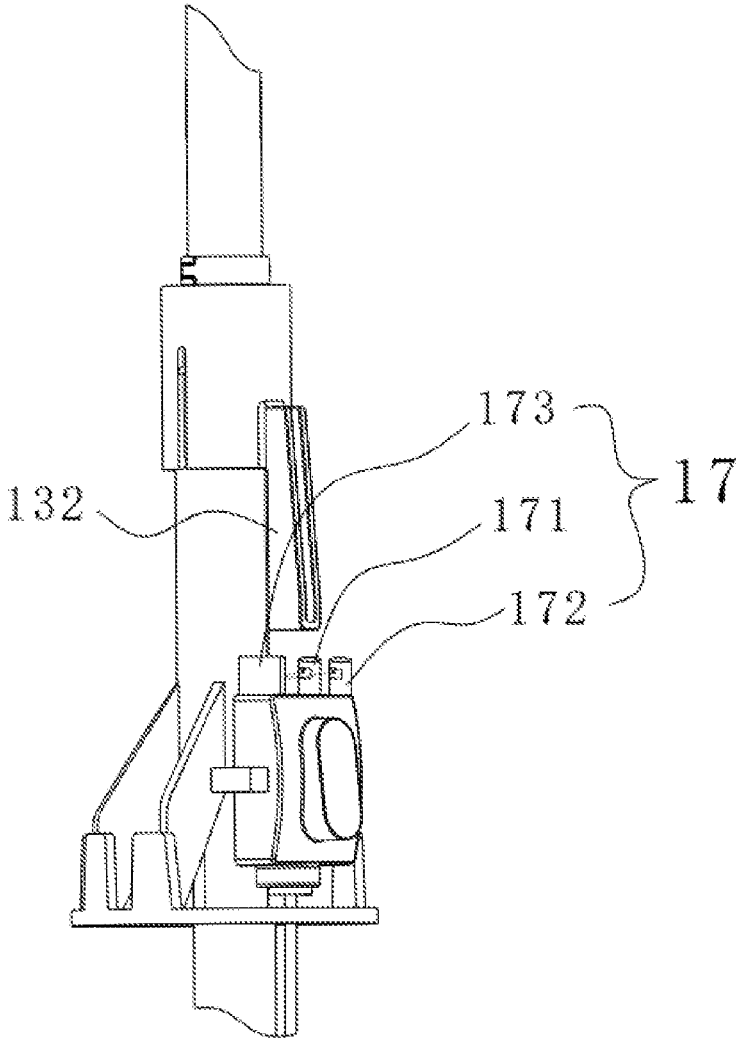
FIG. 13 is a schematic diagram of a switch detection assembly in Embodiment 2.

Referring to FIG. 13, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, a first reflective photoelectric sensor 17 is provided on both sides of the moving path of the extension part 132 of the sliding sleeve 13 as its accepting element, including a second emitting terminal 171 and a second receiving terminal 172 that are provided on the same side of the moving path of the extension part 132, and a first reflective plate 173 provided on the other side of the moving path of the extension part 132 relative to the second transmitting terminal 171 and the second receiving terminal 172. The positional relationship satisfies that the light source emitted from the second transmitting terminal 171 can be received by the second receiving terminal 172 after being reflected by the first reflective plate 173.

When the extension part 132 moves, the conduction of the signal of the first reflective photoelectric sensor 17 is interrupted or not interrupted according to the moving position of the extension part 132, thereby generating a switch signal.

The accepting element of this embodiment is the same as that of Embodiment 1, and both are the type of interrupt sensor.

Embodiment 3

Figure 14:
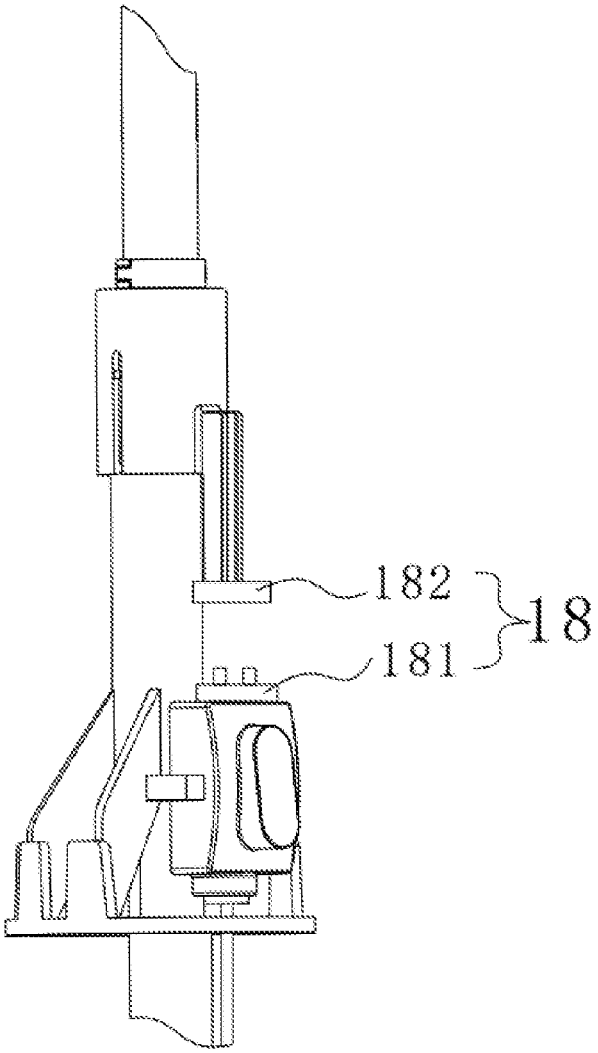
FIG. 14 is a schematic diagram of a switch detection assembly in Embodiment 3.

Referring to FIG. 14, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, an ultrasonic sensing assembly 18 is provided under the extension part 132 of the sliding sleeve 13, including a second reflective plate 182 connected to the lower end of the extension part 132 and an ultrasonic sensor 181 provided under the second reflective plate 182.

When the extension part 132 moves, the ultrasonic sensor 181 obtains ultrasonic feedback of different durations according to the moving position of the extension part 132, thereby generating different signals.

The accepting element of this embodiment is the type of proximity sensor.

Embodiment 4

Figure 15:
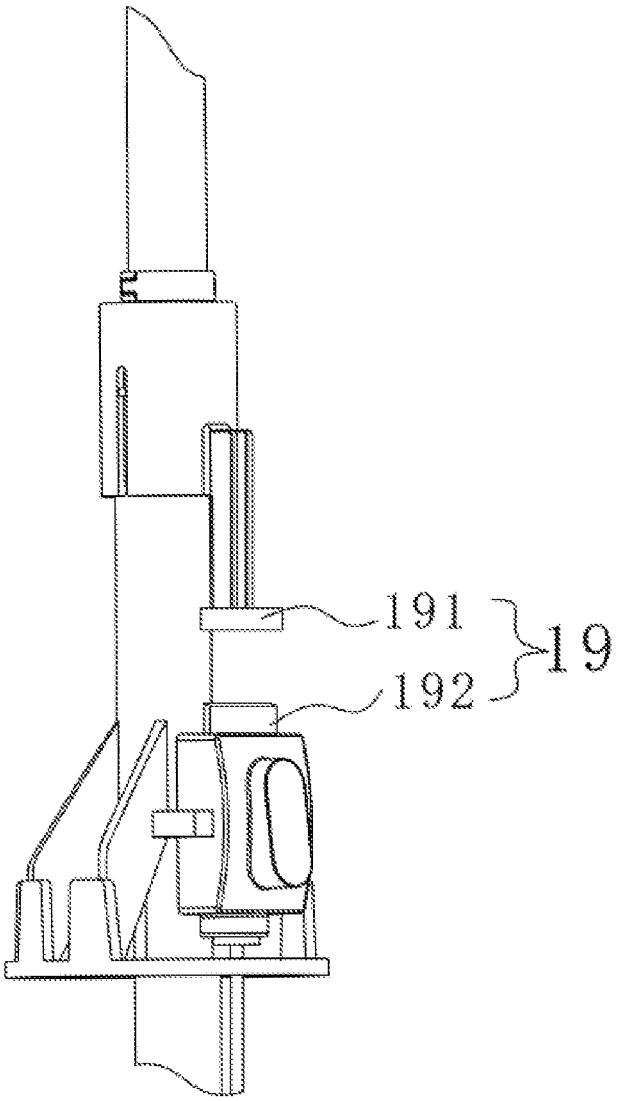
FIG. 15 is a schematic diagram of a switch detection assembly in Embodiment 4.

Referring to FIG. 15, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, a Hall sensing assembly 19 is provided under the extension part 132 of the sliding sleeve 13, including a magnet 191 connected to the lower end of the extension part 132 and a magnetic reed switch 192 provided under the magnet 191.

When the extension part 132 moves, it drives the magnet 191 to move. Due to the Hall effect, when the magnet 191 is close to or far away from the magnetic reed switch 192, the magnetic reed switch 192 will be opened and closed, thereby generating a switch signal.

This embodiment has another feasible alternative solution, which may be:

Similar to the signal collection manner in the background art that controls the on and off of the signal by making a magnetic starting mechanism (magnet+degaussing piece) or a magnet mounted over a water outlet pipe be relatively close to or far away from a magnetic reed switch, the extension part 132 and the circumferential limiting structure (limiting groove 133 and limiting pin 144) are not provided, but an annular magnet (or degaussing piece) is directly installed on the lower end of the pipe body part 131 of the sliding sleeve 13, and a magnetic reed switch (or magnet+magnetic reed switch) is also provided on the lower end of the moving path of corresponding pipe body part 131 on the fixing bracket, thereby achieving a similar technical effect of controlling on and off of the signal. Compared with the solution mentioned in the background art, although this alternative solution can avoid the water leakage problem caused by the cutting of the water pipe, the corresponding magnetic field interference problem still exists. At the same time, compared with the best implementation in FIG. 15, this alternative solution also requires a larger area of magnet or degaussing piece for installation, which increases manufacturing consumption to a certain extent. Therefore, in actual usage occasion, it is recommended to use the best implementation shown in FIG. 15.

The accepting element of this embodiment is the same as that of Embodiment 3, and both are the type of proximity sensor.

Embodiment 5

Figure 16:
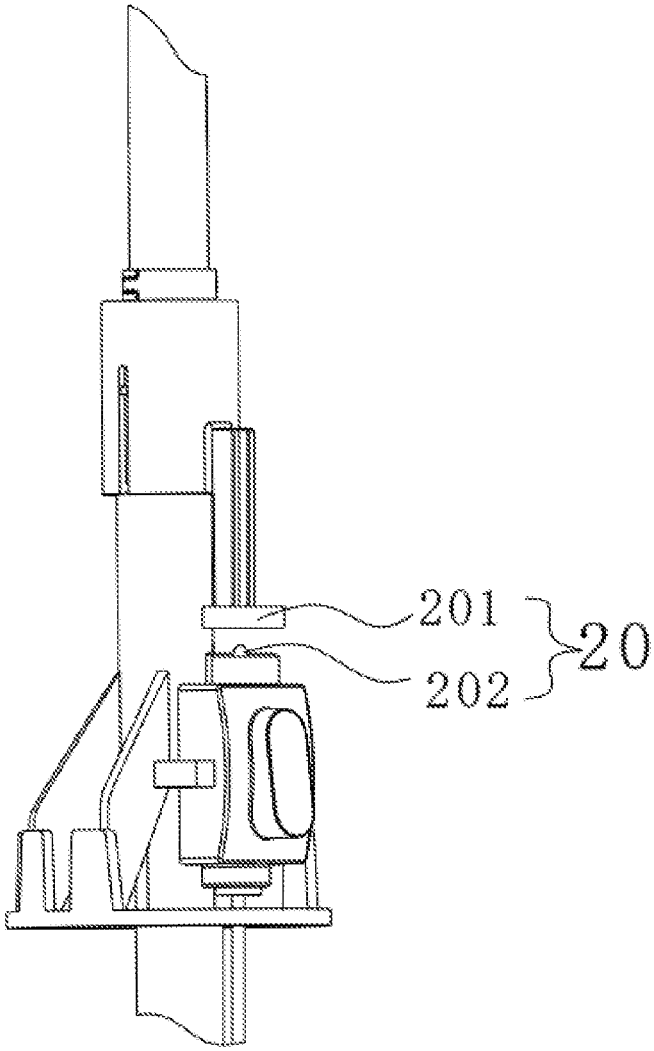
FIG. 16 is a schematic diagram of a switch detection assembly in Embodiment 5.

Referring to FIG. 16, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, a micro switch assembly 20 is provided under the extension part 132 of the sliding sleeve 13, including a pressure plate 201 connected to the lower end of the extension part 132 and a micro switch 202 provided under the pressure plate 201.

When the extension part 132 moves, it drives the pressure plate 201 to move, and the pressure plate 201 moves downwards to contact the normally closed micro switch 202. Under a certain pressure, the micro switch 202 is turned on. When the pressure plate 201 does not contact the micro switch 202, the micro switch 202 is turned off Thus the on and off of the micro switch 202 is controlled to generate a switch signal.

Embodiment 6

Figure 17:
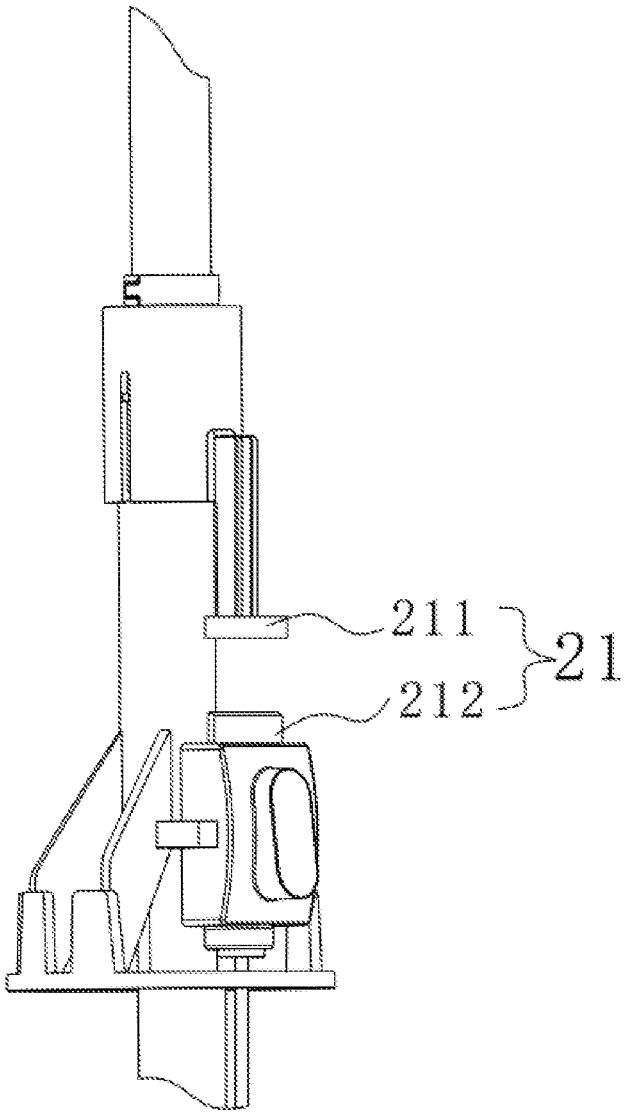
FIG. 17 is a schematic diagram of a switch detection assembly in Embodiment 6.

Referring to FIG. 17, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, a capacitance sensing assembly 21 is provided under the extension part 132 of the sliding sleeve 13, including a conductive rubber skin 211 connected to the lower end of the extension part 132 and a capacitor 212 provided under the conductive rubber skin 211.

When the extension part 132 moves, it drives the conductive rubber skin 211 to move. When the conductive rubber skin 211 is close to or far away from the capacitor 212, the capacitance of the capacitor 212 will change, thereby generating different signals.

The accepting element of this embodiment is the same as those of Embodiments 3 and 4, and both are the type of the proximity sensor.

Embodiment 7

Figure 18:
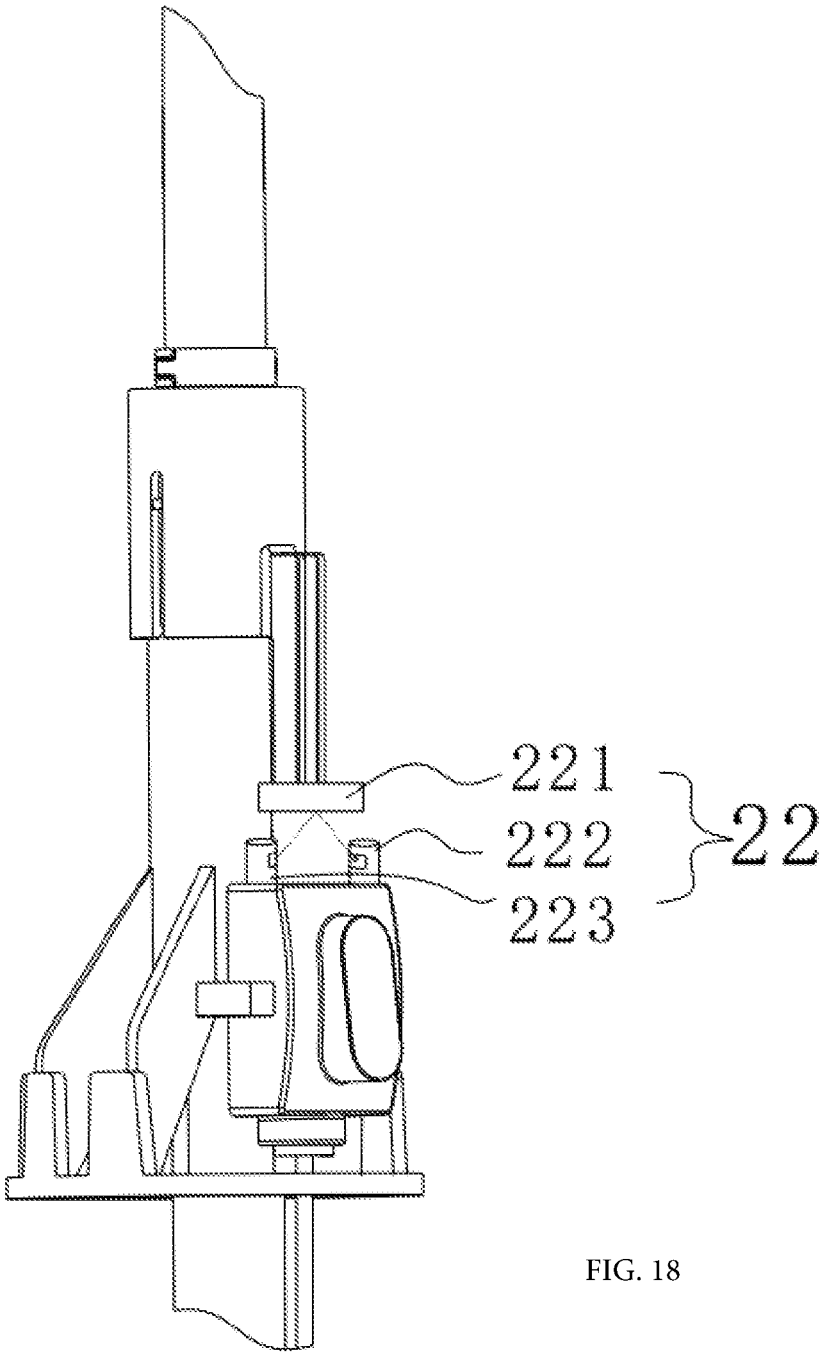
FIG. 18 is a schematic diagram of a switch detection assembly in Embodiment 7.

Referring to FIG. 18, similar to the switch detection assembly in Embodiment 1, this embodiment provides another switch detection assembly, which is applied to a pull-out faucet and has substantially the same structure as that of the switch detection assembly in Embodiment 1, and the difference is that the structure form of the accepting element is different:

In this embodiment, a second reflective photoelectric sensor 22 is provided on both sides of the moving path of the extension part 132 of the sliding sleeve 13, including a third transmitting terminal 222 and a third receiving terminal 223 provided on both sides of the moving path of the extension part 132, and a third reflective plate 221 connected to the lower end of the extension part 132. The positional relationship satisfies that the light source emitted from the third transmitting terminal 222 can be received by the third receiving terminal 223 after being reflected by the third reflective plate 221 at a specific position.

When the extension part 132 moves, the conduction of the signal of the second reflective photoelectric sensor 22 is interrupted or not interrupted according to the moving position of the extension part 132, thereby generating a switch signal.

The accepting element of this embodiment is the same as those of Embodiments 1 and 2, and both are the type of interrupt sensor.

The above several embodiments show the application of the switch detection assembly provided by the present invention in the pull-out faucet, but the switch detection assembly provided by the present invention is suitable for various applications where a switch signal is triggered by a pull-out tubular (or linear continuous shape such as linear and cord) object, such as:

1. Applied to a car washing machine, the switch signal is triggered by a pull-out water pipe to control on and off of car washing machine jetting water.

2. Applied to a nitrogen spray gun, the switch signal is triggered by a pull-out air pipe to control on and off of the nitrogen spray gun spraying nitrogen.

It should be noted that, according to different applications, the switch detection assembly of the present invention may employ fixing brackets, movable sleeves, elastic reset elements, diameter expanding elements and accepting elements of different structure forms, as well as pull-out tubular (or linear continuous shape such as linear and cord) objects installed in different structure forms.

Compared with the technical solutions in CN204664566U and CN203927007U, the present invention is advanced in that: First, it is not necessary to cut the water outlet pipeline to install the sensing apparatus, which ensures the continuity of the water outlet pipeline, avoids the problem of water leakage and saves the process of production and assembly. Second, if the preferred solution of the circumferential limiting structure is employed, the problem that the water outlet pipeline is susceptible to revolving and sway and the accuracy of signal triggering is affected can be further solved, and even if the present invention also uses the Hall sensor (Embodiment 4) to trigger the switch signal, it is not necessary to use a magnet with a strong magnetic field, so as not to affect the operation of the other electronic control components in the apparatus. Third, the applicability of the present invention is stronger. The switch detection assembly provided by the present invention is suitable for various applications where the switch signal is triggered by a pull-out linear continuous shape object (such as the above-mentioned car washing machine and nitrogen spray gun). Moreover, various proximity sensors, interrupt sensors, or pressure-triggered mechanical switches can be used, and the sensor type can be flexibly selected according to the device status to be used, accuracy requirement, installation space, and cost consideration.

Although the present invention has been specifically shown and described in conjunction with the preferred embodiments, those skilled in the art should understand that various changes made to the present invention in form and detail are within the protection scope of the present invention, without departing from the spirit and scope of the present invention as defined by the appended claims.

What is claimed is:

1. A switch detection assembly used to perform switch detection on a movement stroke of a linear continuous shape object, including a sleeve sliding pair, the sleeve sliding pair has a movement stroke having a first direction and a second direction that deviate from each other, the sleeve sliding pair is used for the linear continuous shape object to extend and receives a unidirectional force of the linear continuous shape object to generate the movement stroke in the first direction, the movement stroke in the second direction of the sleeve sliding pair is capable of continuously reset, and the movement stroke is accepted and a switch signal output is generated;

the switch detection assembly further comprises a fixing bracket, a sliding sleeve, an elastic reset element, a diameter expanding element and an accepting element, the fixing bracket is fixedly provided and includes a fixing sleeve, the fixing sleeve has a passage for the linear continuous shape object to pass through, and defines two ends of the passage as a first end and a second end corresponding to the first direction and the second direction;

the sliding sleeve is movably mounted over the fixing sleeve, so as to be able to make a linear reciprocating movement towards the first end or the second end relative to the fixing sleeve and have a movement stroke;

the fixing bracket and the sliding sleeve form the sleeve sliding pair;

the elastic reset element is used to achieve the reset and includes a first force application action end and a second force application action end, the first force application action end and the second force application action end respectively act on the fixing sleeve and the sliding sleeve, so that the elastic reset element generates an elastic restoring force against the movement of the sliding sleeve towards the first end, and the elastic restoring force is in a direction towards the second end of the passage;

the diameter expanding element is used to achieve the unidirectional force application, and the diameter expanding element is fixedly installed in at least one position of the linear continuous shape object, so that when the linear continuous shape object moves towards the first end in the passage of the fixing sleeve, the diameter expanding element applies pressure to the sliding sleeve and generates the movement stroke relative to the fixing sleeve;

the accepting element is used to accept the movement stroke and generate the switch signal output, the accepting element is installed in a range roughly equivalent to the movement stroke of the sliding sleeve, so that when the sliding sleeve makes the linear reciprocating movement, the accepting element can accept stroke change of the sliding sleeve and generate the switch signal output.

2. The switch detection assembly according to claim 1, wherein the sliding sleeve includes a vertically provided pipe body, an inner cavity of the pipe body is a through shaft hole, the pipe body has a first pipe port at an end facing the first direction and has a second pipe port at an end facing the second direction, a diameter reducing part extending radially to a center of circle is provided at the second pipe port.

3. The switch detection assembly according to claim 2, wherein the diameter expanding element applies pressure to the diameter reducing part of the sliding sleeve, so that the sliding sleeve generates a movement stroke relative to the fixing sleeve.

4. The switch detection assembly according to claim 2, wherein the fixing sleeve is a hollow pipe body, the fixing sleeve has a protruding part protruding outwards along an outer pipe wall of the fixing sleeve, the protruding part is for the first force application action end of the elastic reset element to act on, the elastic reset element is a compression spring, one end of the compression spring resists and acts on the protruding part as the first force application action end, and another end of the compression spring resists and acts on the diameter reducing part as the second force application action end.

5. The switch detection assembly according to claim 4, wherein the protruding part is an annularly convex shaft shoulder on the outer pipe wall of the fixing sleeve.

6. The switch detection assembly according to claim 4, wherein the sliding sleeve and the fixing sleeve are provided with a limiting mechanism that limits a range of the movement stroke of the sliding sleeve.

7. The switch detection assembly according to claim 6, wherein the first pipe port of the sliding sleeve has a convex clamping part extending radially to the center of circle, and when the sliding sleeve is mounted over the fixing sleeve, the clamping portion can pass over the protruding part; limiting in one direction of the limiting mechanism is achieved by limiting of the clamping part and the protruding part.

8. The switch detection assembly according to claim 7, wherein the clamping part is an annular convex.

9. The switch detection assembly according to claim 2, wherein the sliding sleeve further includes an extension part that is fixedly connected to outside of the pipe body and extends towards the first direction or the second direction.

10. The switch detection assembly according to claim 9, wherein when the sliding sleeve makes the linear reciprocating movement, the extension part is relatively close to or far away from the accepting element, and the accepting element accepts stroke change of the sliding sleeve according to the extension part being relatively close to or far away from the accepting element, and the accepting element generates a switch signal.

11. The switch detection assembly according to claim 1, wherein the elastic reset element is one of an elastic piece, an extension spring, and a tension rope.

12. The switch detection assembly according to claim 1, wherein the sliding sleeve and the fixing sleeve are provided with a circumferential limiting mechanism that limits rotation of the sliding sleeve relative to the fixing sleeve.

13. The switch detection assembly according to claim 12, wherein the fixing sleeve is provided with a limiting pin protruding outwards from the fixing sleeve, and a limiting groove is provided on the sliding sleeve at a position corresponding to the limiting pin.

14. The switch detection assembly according to claim 13, wherein the limiting groove is roughly "U" shaped.

15. The switch detection assembly according to claim 13, wherein there are two groups of the limiting pin and the limiting groove, which are distributed at 180°.

16. The switch detection assembly according to claim 1, wherein the accepting element is a proximity sensor, an interrupt sensor or a mechanical triggering switch.

17. A faucet including a water inlet pipe, a water outlet pipe which can be pulled out, and a control system for controlling water inlet and/or water outlet manner, further including the switch detection assembly according to claim 1, the switch detection assembly performs switch detection on a pull-out movement stroke of the water outlet pipe, generates a switch signal and delivers it to the control system, and the control system controls the water inlet and/or water outlet manner according to the switch signal.

* * * * *